US008427403B2

(12) United States Patent
Shin

(10) Patent No.: US 8,427,403 B2
(45) Date of Patent: Apr. 23, 2013

(54) DEMULTIPLEXER, DISPLAY APPARATUS USING THE SAME, AND DISPLAY PANEL THEREOF

(75) Inventor: Dong-Yong Shin, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1318 days.

(21) Appl. No.: 11/139,422

(22) Filed: May 27, 2005

(65) Prior Publication Data

US 2006/0001618 A1 Jan. 5, 2006

(30) Foreign Application Priority Data

Jun. 30, 2004 (KR) ..... 10-2004-0050606

(51) Int. Cl.
*G09G 3/30* (2006.01)

(52) U.S. Cl.
USPC ..... 345/79; 345/82

(58) Field of Classification Search ..... 345/204, 345/76–77, 82–83, 79; 315/169.3
See application file for complete search history.

(56) References Cited

U.S. PATENT DOCUMENTS

| | | | | |
|---|---|---|---|---|
| 6,924,784 | B1 * | 8/2005 | Yeo et al. | 345/98 |
| 2001/0052888 | A1 | 12/2001 | Hebiguchi | |
| 2002/0190927 | A1 * | 12/2002 | Shoji et al. | 345/60 |
| 2002/0196213 | A1 * | 12/2002 | Akimoto et al. | 345/82 |
| 2003/0016189 | A1 * | 1/2003 | Abe et al. | 345/55 |
| 2003/0043131 | A1 * | 3/2003 | Iguchi | 345/204 |
| 2003/0090451 | A1 * | 5/2003 | Ahn | 345/96 |
| 2003/0179164 | A1 * | 9/2003 | Shin et al. | 345/76 |
| 2003/0227262 | A1 * | 12/2003 | Kwon | 315/169.3 |
| 2004/0104880 | A1 * | 6/2004 | Kang et al. | 345/94 |
| 2004/0145581 | A1 * | 7/2004 | Morita | 345/204 |
| 2004/0222472 | A1 * | 11/2004 | Suzuki et al. | 257/365 |
| 2004/0233141 | A1 * | 11/2004 | Matsumoto | 345/76 |
| 2005/0024297 | A1 * | 2/2005 | Shin | 345/76 |
| 2005/0134781 | A1 * | 6/2005 | Kim | 349/139 |
| 2005/0168491 | A1 | 8/2005 | Takahara et al. | |
| 2005/0179624 | A1 * | 8/2005 | Sun | 345/76 |

FOREIGN PATENT DOCUMENTS

| | | | |
|---|---|---|---|
| CN | 1428757 | A | 7/2003 |
| CN | 1432989 | A | 7/2003 |
| CN | 1447302 | A | 10/2003 |
| CN | 1503216 | A | 6/2004 |
| JP | 09-138659 | A | 5/1997 |
| JP | 2003-510661 | T | 3/2003 |
| JP | 2003-122306 | A | 4/2003 |
| JP | 2004-029791 | A | 1/2004 |
| JP | 2004-146082 | | 5/2004 |
| JP | 2004-170768 | A | 6/2004 |
| WO | WO 01/06484 | A1 | 1/2001 |
| WO | WO/0124153 | A | 4/2001 |
| WO | WO 03/091978 | A1 | 6/2003 |
| WO | WO 2004/025614 | A1 | 3/2004 |

* cited by examiner

*Primary Examiner* — Chanh Nguyen
*Assistant Examiner* — Long D Pham
(74) *Attorney, Agent, or Firm* — Christie, Parker & Hale, LLP

(57) ABSTRACT

A display apparatus includes a data driver outputting a data current as image signals, a plurality of data lines for applying the data currents, and a plurality of pixel circuits coupled to the data lines At least one of the plurality of pixel circuits has a driving circuit outputting a current corresponding to the data current, a demultiplexer demultiplexing the output current of the driving circuit and outputting the output current to at least two output terminals, and at least two light emitting elements coupled to the at output terminals of the demultiplexer, and emitting light corresponding to an inputted current.

23 Claims, 12 Drawing Sheets

DEMULTIPLEXER, DISPLAY APPARATUS USING THE SAME, AND DISPLAY PANEL THEREOF

CROSS REFERENCE TO RELATED APPLICATION

This application claims priority to and the benefit of Korean Patent Application No. 10-2004-0050606 filed on Jun. 30, 2004 in the Korean Intellectual Property Office, the entire content of which is incorporated herein by reference.

BACKGROUND OF THE INVENTION

1. Field of the Invention

In an exemplary embodiment, the present invention relates to a demultiplexer and a display apparatus using a demultiplexer, and a display panel thereof. More particularly, the present invention relates to a demultiplexer for demultiplexing a data current.

2. Discussion of the Related Art

In general, an organic light emitting diode (also referred to as "OLED," hereinafter) display device electrically excites phosphorus organic components, and represents an image by voltage or current programming m×n organic light emitting pixels. Each of these organic light emitting pixels includes anode, organic thin film, and cathode layers. The organic thin film layer has a multi-layered structure including an emission layer (EML), an electron transport layer (ETL), and a hole transport layer (HTL) to balance electrons and holes thereby enhancing efficiency of light emission. Furthermore, the organic thin film layer includes an electron injection layer (EIL) and a hole injection layer (HIL).

Methods of driving the organic light emitting pixels having the foregoing configuration include a passive matrix method and an active matrix method. The active matrix method employs a thin film transistor (TFT). In the passive matrix method, an anode and a cathode are formed crossing (or crossing over) each other and a line is selected to drive the organic light emitting pixels. On the other hand, in the active matrix method, an indium tin oxide (ITO) pixel electrode is coupled to the TFT, and a voltage maintained by the capacitance of a capacitor coupled to a gate of the TFT drives the light emitting pixel. The active matrix method can also be classified into a voltage programming method and a current programming method depending on a type of signal transmission to distinctively program the voltage applied to the capacitor.

Such an OLED display device requires a scan driver for driving scan lines and a data driver for driving data lines. The data driver converts digital data signals into analog data signals to apply to all the data lines. Therefore, the number of output terminals should correspond to the number of data lines. However, a typical data driver has only a limited number of output terminals and thus a number of integrated circuits (ICs) are typically used to drive all the data lines.

SUMMARY OF THE INVENTION

In an exemplary embodiment, the present invention provides a display device and a driving method thereof to reduce the number of integrated circuits used for a data driver.

Additional features of the invention will be set forth in the description which follows, and in part will be apparent from the description, or may be learned by practice of the invention In an exemplary embodiment, the present invention discloses a display apparatus including a data driver, a plurality of data lines, and a plurality of pixel circuits. The data driver outputs a data current as image signals. The plurality of data lines transmit the data currents. The plurality of pixel circuits are coupled to the data lines. At least one of the pixel circuits includes a driving circuit; a demultiplexer; and at least two light emitting elements. The driving circuit outputs a current corresponding to the data current. The demultiplexer demultiplexes the output current of the driving circuit and outputs the output current to at least two output terminals. The at least two light emitting elements are coupled to the output terminals of the demultiplexer, and emit light corresponding to an inputted current.

In another exemplary embodiment, the present invention discloses a display apparatus including a display area, a data driver, and a scan driver. The display area has a plurality of data lines, a plurality of scan lines, and a plurality of pixel circuits. The plurality of data lines transmit data currents. The plurality of scan lines transmit selection signals. The plurality of pixel circuits are respectively coupled to the data lines and the scan lines. The data driver generates data currents to be programmed to the plurality of pixel circuits, and applies the one of the data currents to the plurality of data line. The scan driver generates the selection signal, and applies selection signals to the plurality of scan lines. The plurality of pixel circuits includes at least two light emitting elements displaying an image corresponding to a data current applied thereto, and demultiplexes a current corresponding to the one of the data currents and transmits the data current to the light emitting elements.

The present invention discloses in a further embodiment a display panel including: a data driver, a plurality of data lines, and a plurality of pixel circuits. The data driver outputs a data current as a image signal. The plurality of data lines transmit one of the data currents. The plurality of pixel circuits are coupled to the data lines, and display an image corresponding to one of the data currents. The plurality of pixel circuits include a driving circuit, at least two light emitting elements, and a demultiplexer. The driving circuit outputs a current corresponding to one of the data currents. The at least two light emitting elements display an image corresponding to an input current. The demultiplexer demultiplexes the output current of the driving circuit and transmits the demultiplexed current to the at least two light emitting elements.

In an exemplary embodiment, the present invention discloses a driving method of a display apparatus including a plurality of data lines, a plurality of scan lines, and a plurality of pixel. The plurality of data lines transmit data currents. The plurality of scan lines transmit selection signals. The plurality of pixel circuits are respectively coupled to the data lines and the scan lines. In the method, the data currents are programmed to the pixel circuits during application of the selection signals, a current corresponding to the data currents is outputted, and the output current is demultiplexed and transmitted to one of at least two light emitting elements.

In another exemplary embodiment, the present invention discloses a display apparatus including a data driver, a plurality of data lines, and a plurality of pixel circuits. The data driver outputs data currents as an image signal. The plurality of data lines transmit data currents. The plurality of pixel circuits are coupled to the data lines, and include a driving circuit, a light emitting element, and a switch. The driving circuit outputs a current corresponding to the data currents in response to an emission signal. The light emitting element emits light corresponding to a current outputted from the driving circuit. The switch transmits the output current of the driving circuit. The switch transmits the output current of the driving circuit to the light emission element. An emission signal applied to the plurality of pixel circuits having first and second pixel circuits is the same as the emission signal emitted from the light emission element, and the switch is alternately turned on in the first and second pixel circuits.

BRIEF DESCRIPTION OF THE DRAWINGS

The accompanying drawings, together with the specification, illustrate exemplary embodiments of the present invention, and together with the description serve to explain the principles of the present invention.

DETAILED DESCRIPTION

Figure 1:
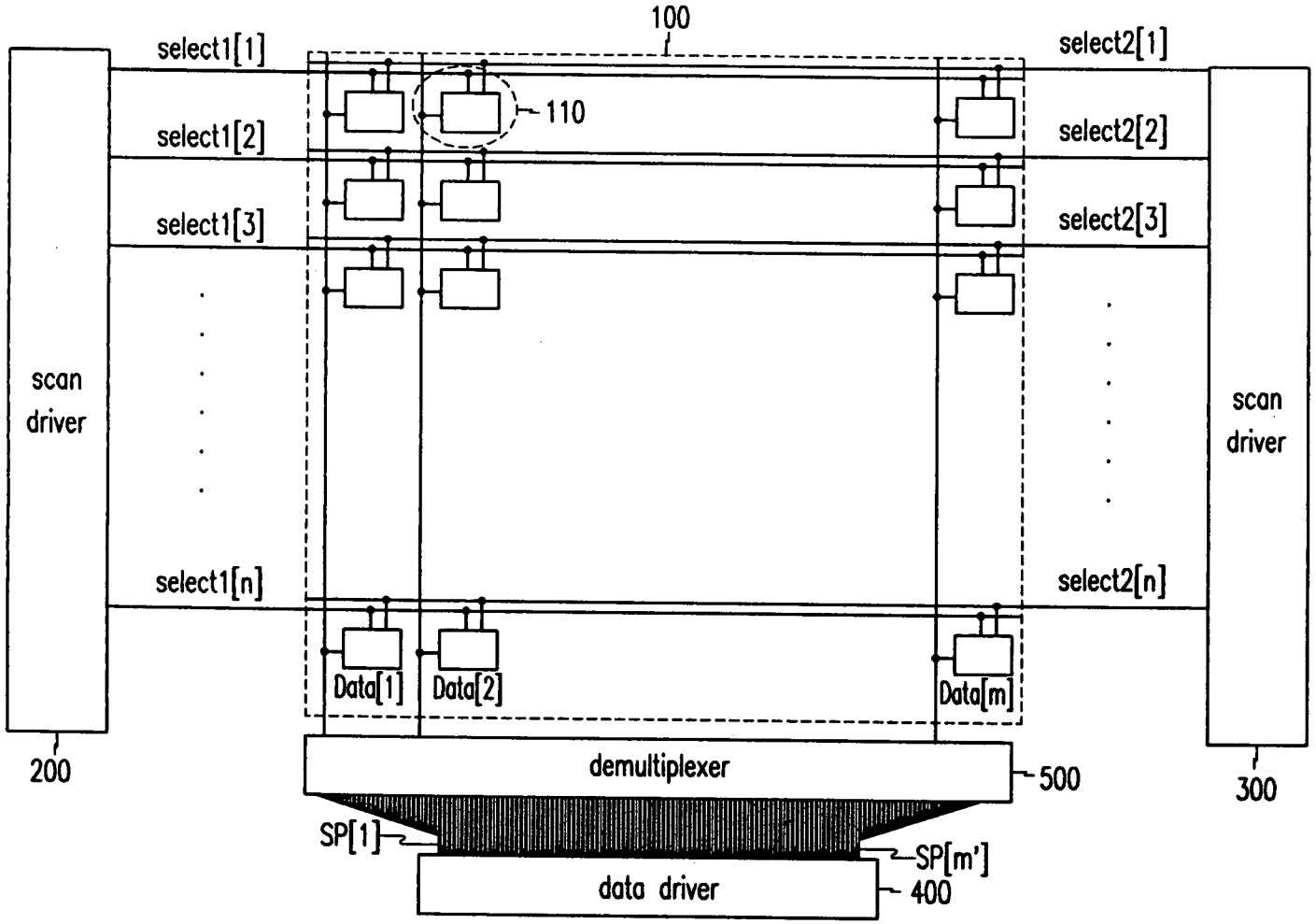
FIG. 1 illustrates a display apparatus according to a first exemplary embodiment of the present invention.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Like reference numerals designate like elements. Phrases such as "coupling one thing to another" can refer to either "directly coupling a first one to a second one" or "coupling the first one to the second one with a third one provided therebetween".

Hereinafter, exemplary embodiments of the present invention will be described in detail with reference to the drawings.

FIG. 1 shows a display device according to an exemplary embodiment of the present invention.

As shown in FIG. 1, a display device according to the exemplary embodiment of the present invention includes a display panel 100, scan drivers 200 and 300, a data driver 400, and a demultiplexer 500.

The display panel 100 includes a plurality of data lines Data[1] to Data[m], a plurality of selection scan lines select1[1] to select1[*n*], a plurality of emission scan lines select2[1] to select2[*n*], and a plurality of pixel circuits 110. The plurality of data lines Data[1] to Data[m] are arranged as columns, and transmit data currents for displaying an image to the pixel circuits 110. The plurality of selection scan lines select1[1] to select1[*n*] and the plurality of emission scan lines select2[1] to select2[*n*] are arranged as rows, and respectively transmit selection signals and emission signals to the pixel circuits 110. Each pixel circuit 110 is formed in an area where the data line, the emission scan line, and the selection scan line are adjacent to each other.

The scan driver 200 sequentially applies the selection signals to the selection scan lines select1[1] to select1[*n*], and the scan driver 300 sequentially applies the emission signals to the emission scan lines select2[1] to select2[*n*]. The data driver 400 outputs the data currents to the demultiplexer 500 through signal lines SP[1] to SP[m'], and the demultiplexer demultiplexes the data currents inputted through the signal lines SP[1] to SP[m'] and transmits the demultiplexed data currents to the data lines Data[1] to Data[m].

According to the exemplary embodiment of the present invention, the demultiplexer is a 1:2 demultiplexer that demultiplexes and provides each data signal (e.g., a data current) inputted from the data driver 400 in a time-divided or multiplexed manner to two data lines. In other words, data signals for the two data lines are time-divisionally multiplexed in a single data signal inputted from the data driver 400. A 1:N demultiplexer (i.e., 1:3 or 1:4) can be employed according to other embodiments of the present invention. While N should generally be an integer less than or equal to 3, N may be larger than 3 in some embodiments.

The scan drivers 200 and 300, the data driver 400, and/or the demultiplexer 500 can be coupled to the display panel 100, or provided as a chip that can be installed to a tape carrier package (TCP) or a flexible printed circuit (FPC) attached to the display panel. Alternatively, the scan drivers 200 and 300, the data driver 400, and/or the demultiplexer 500 can be directly attached to a glass substrate of the display panel 100, and they may be replaced with a driving circuit formed on a glass substrate, wherein the driving circuit is layered in a like manner as how the scan lines, the data lines, and the TFTs are layered.

Figure 2:
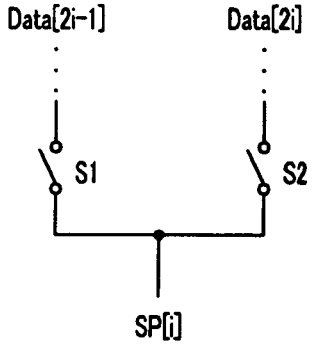
FIG. 2 is a simplified circuit diagram illustrating a partial internal configuration of a demultiplexer according to the first exemplary embodiment of the present invention.

Hereinafter, a demultiplexer 500 according to an exemplary embodiment of the present invention will be described with reference to FIGS. 1 and 2. FIG. 2 illustrates a part of the demultiplexer 500, and may be referred to as a demultiplexer unit. In practice, the demultiplexer 500 would include a plurality of demultiplexer units (e.g. m' demultiplexer units) that are arranged in parallel to time-divisionally demultiplex the data signals (e.g., data currents) received over the signal lines SP[1] to SP[m'].

As can be seen from FIGS. 1 and 2, the demultiplexer 500 is coupled to the data driver 400 through the signal lines SP[1] to SP[m'], and transmits a data signal (e.g., a data current) transmitted from one signal line SP[i] in a time-divided or multiplexed manner, to two data lines Data[2*i*−1] and Data[2*i*]. Two switches S1 and S2 are coupled to one signal line SP[i], these switches S1 and S2 are respectively coupled to the data lines Data[2*i*−1] and Data[2*i*] to demultiplex the data currents that are provided as a multiplexed data current in one signal line SP[i].

The switches S1 and S2 are alternately turned off and on in response to a control signal, and transmit the data signal from the signal line SP[i] to the data lines Data[2*i*−1] and Data[2*i*], respectively. The switches S1 and S2 can be replaced with n-MOS transistors, p-MOS transistors, or any other suitable transistors or switches known to those skilled in the art.

Hereinafter, an operation of the demultiplexer according to a first exemplary embodiment of the present invention will be described, referring to FIG. 3.

Figure 3:
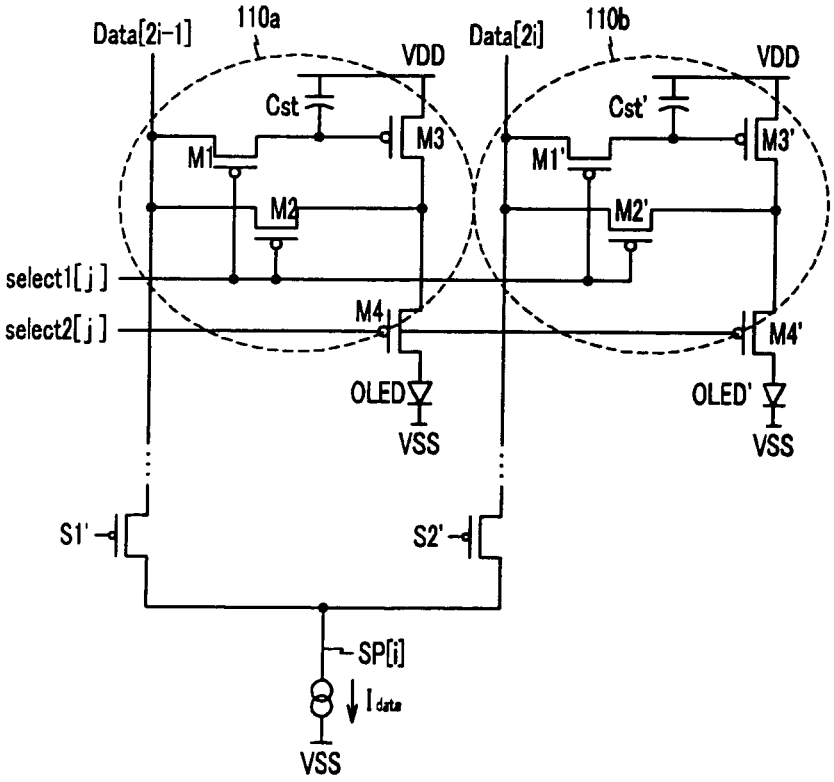
FIG. 3 illustrates a relationship between the demultiplexer and a pixel circuit according to the first exemplary embodiment of the present invention.

FIG. 3 illustrates a relationship between the demultiplexer and a pixel circuit according to the first exemplary embodiment of the present invention. FIG. 3 mainly illustrates pixel circuits 110*a* and 110*b* coupled to data lines Data[2*i*−1] and Data[2*i*] and scan lines select1[*j*] and select2[*j*], and a demultiplexer coupled between the data lines Data[2*i*−1] and Data [2*i*] and a signal line SP[i]. By way of example, the pixel circuits 110*a* and 110*b* of FIG. 3 may be any two adjacent pixel circuits 110 of FIG. 1 that are respectively coupled to an odd data line Data[2*i*−1] and an even data line Data[2*i*] of the m data lines Data[1] to Data[m].

The pixel circuit 110*a* includes transistors M1, M2, M3 and M4, a capacitor Cst, and an OLED display element or organic light emitting diode (OLED), and the pixel circuit 110*b* includes transistors M1', M2', M3' and M4', capacitor Cst', and an OLED display element (OLED').

When the selection signal from the scan line select[s] becomes low, the transistors M1, M2, M1', and M2' are turned on. At this time, the data signal is applied to the pixel circuit 110*a* through the data line Data[2*i*−1] when a switch S1 is turned on. Thus, the transistor M3 is diode-connected by the transistors M1 and M2 and a voltage corresponding to the data signal (e.g., data current) from the data line Data[2*i*−1] is applied to the capacitor Cst.

When a switch S2' is turned on, the data signal from the signal line SP[i] is applied to the pixel circuit 110*b* through the data line Data[2*i*]. Further, the transistor M3' is diode-connected by the transistors M1' and M2' and a voltage corresponding to the data signal (e.g., data current) from the data line Data[2*i*] is applied to the capacitor Cst'. At this time, the switch S1' is turned off, and accordingly no current or a current of 0A is transmitted through the data line Data[2*i*−1] and a voltage (blank signal) corresponding to the current of 0A is applied to the capacitor Cst.

Hence, no current or the current of 0A flows to the OLED in the pixel circuit 110*a* when an emission signal from the scan line select2[j] turns on the transistors M4 and M4' to emit light from the pixel circuits 110*a* and 110*b*. In other words, the pixel circuit 110*a* cannot display an expected gray scale and becomes a blank state.

Using separate scan lines for the circuits 110*a* and 110*b* may prevent the foregoing problem, but, at the same time, increases the number of lines, thereby decreasing an aperture ratio. Further, additional scan drivers are required to control these separate scan lines, thereby causing manufacturing expenses to be increased.

To alleviate the foregoing problem, the demultiplexer according to a second exemplary embodiment divides one frame into a plurality of fields, and alternately applies a data current to two adjacent pixel circuits.

The following description will be focused on a case in which one frame is divided into a first field and a second field, and a data current is alternately applied to the first pixel circuit and the second pixel circuit. However, one frame may be divided into more than three fields and the length of each field may be varied in other embodiments of the present invention.

Hereinafter, an operation of the demultiplexer according to the second exemplary embodiment of the present invention will be described with reference to FIGS. 4 to 7.

Figure 4:
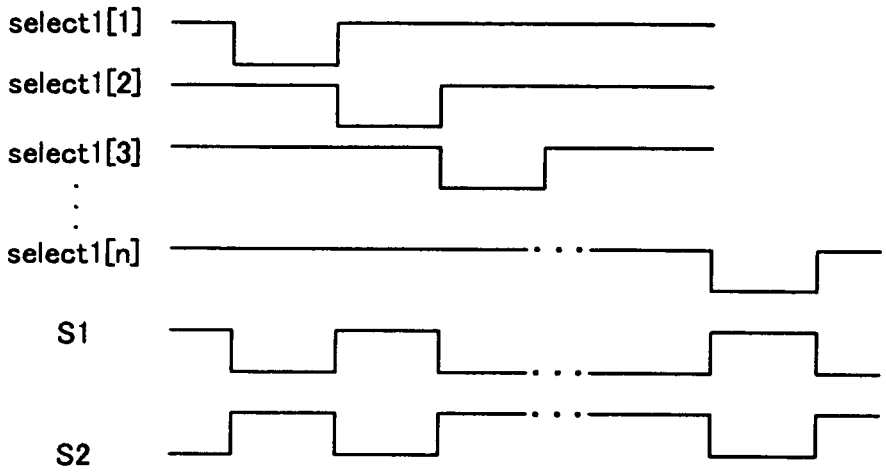
FIG. 4 illustrates driving and timing diagrams of the demultiplexer in a first field according to a second exemplary embodiment of the present invention.
Figure 5:
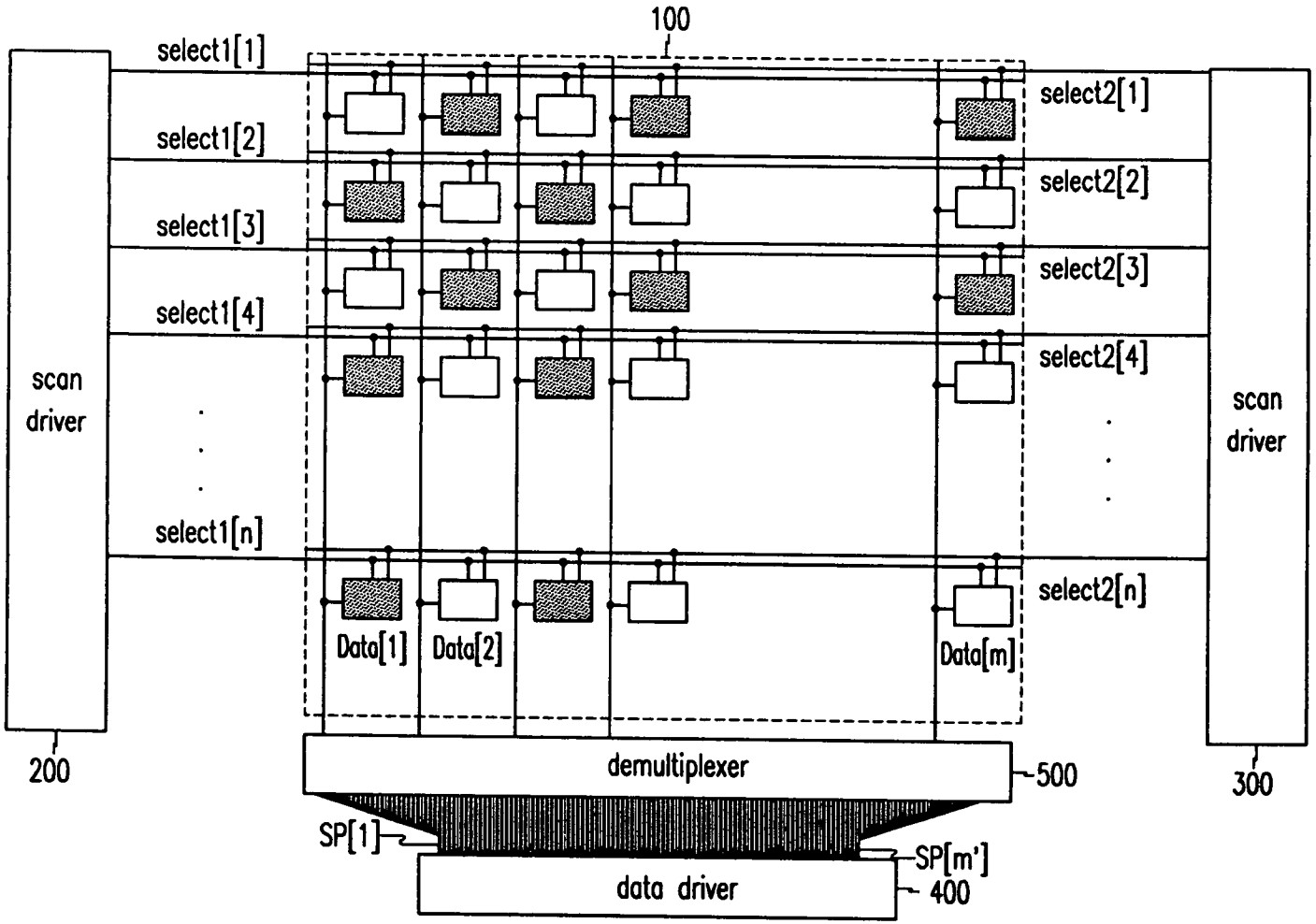
FIG. 5 shows pixel circuits turned on in the first field.

FIG. 4 illustrates driving timing diagrams of the demultiplexer in the first field, and FIG. 5 illustrates pixels that are turned on in the first field. The pixels that are turned on in the first field are the ones that are not shown as grayed or blacked out in FIG. 5

In the first field, the switches S1 and S2 are alternately turned on and off while the selection signal is applied to the scan lines select1[1] to select1[*n*], as shown in FIG. 4.

In more detail, the switch S1 is turned on and the switch S2 is turned off when the selection signal is applied to the scan line select1[1]. In this case, the data signal is applied to the data line Data[2*i*−1] only and the data signal applied to the data line Data[2*i*] is cut off. Accordingly, when the emission signal is applied to the scan line select2[1], the pixel circuit 110*a* coupled to the scan line select1[1] and the data line Data[2*i*−1] emits light, whereas the pixel circuit 110*b* coupled to the scan line select1[1] and the data line Data[2*i*] assumes the blank state and thus no light is emitted therefrom.

Thus, the emission signal should, but not necessarily, be applied to the scan line select2[1] after an enable period of the selection signal applied to the scan line select1[1] has ended. Further, the pixel circuit can be set to emit light right after the end of the enable period of the selection signal by removing the scan lines select2[1] to select2[*n*] transmitting the emission signals and changing the transistors M4 and M4' in FIG. 3 to n-MOS transistors, followed by coupling gates of the transistors M4 and M4' to the scan lines select1[1] to select1 [*n*].

When the selection signal is applied to the scan line select1 [2], the switch S2 is turned on and the switch S1 is turned off. Accordingly, the data signal is applied to the data line Data [2*i*] only and the data signal applied to the data line Data[2*i*−1] is cut off. In other words, when the emission signal is applied to the scan line select2[2], a pixel circuit (e.g., pixel circuit coupled to the scan line select1[2] and the data line Data[2] of FIG. 5) coupled to the scan line select1[2] and the data line Data[2*i*] emits light, whereas a pixel circuit (e.g., pixel circuit coupled to the scan line select1[2] and the data line Data[1] of FIG. 5) coupled to the scan line select1[2] and the data line Data[2*i*−1] assumes the blank state and is unable to emit light.

In a like manner, the data signals are sequentially applied to the data line Data[2*i*−1] and the data line Data[2] by alternately turning on and off the switches S1 and S2 while the selection signal is applied to the scan lines select1[3] to select1[*n*]. Consequently, the data signals are applied to the pixel circuits coupled to the odd numbered scan line select1 [2*j*−1] and the odd numbered data line Data[2*i*−1], and then applied to the pixel circuits coupled to the even numbered scan line select1[2*j*] and the even numbered data line Data [2*j*], as shown in FIG. 5. Further, the pixel circuit to which the data signal is applied emits light until it assumes the blank state, that is, a half period of one frame. However, the light emission period of the pixel circuit may be extended or shortened by adjusting timing of the emission signal.

Figure 6:
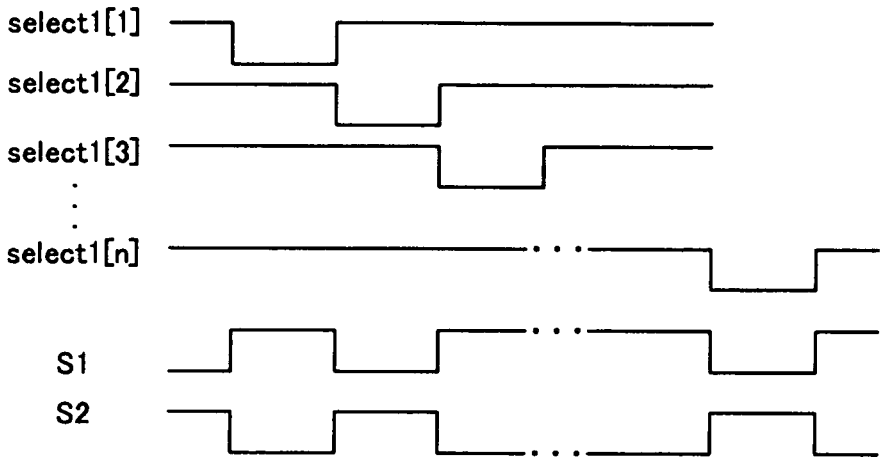
FIG. 6 illustrates driving timing diagrams of the demultiplexer in a second field according to the second exemplary embodiment of the present invention.
Figure 7:
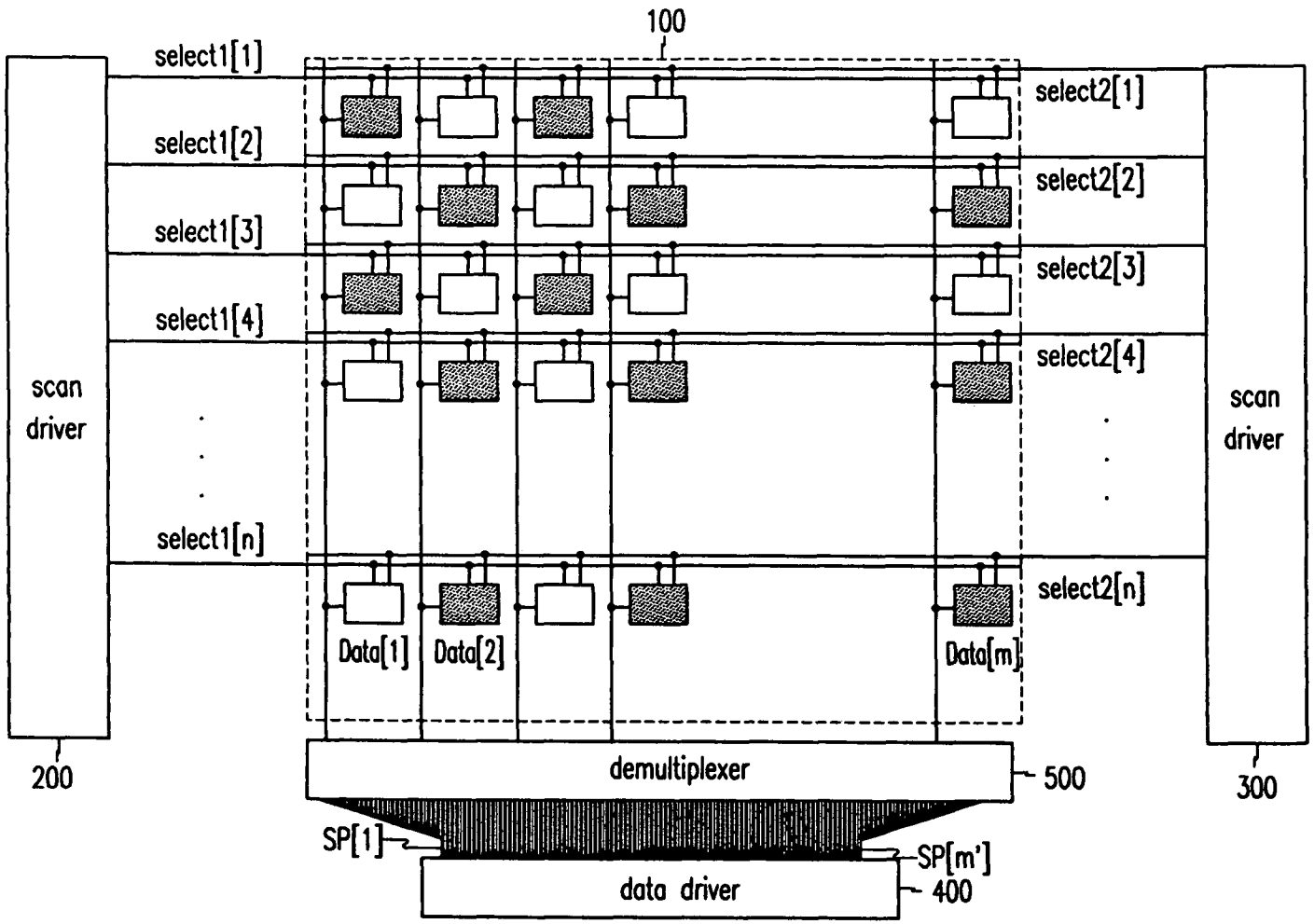
FIG. 7 shows pixel circuits turned on in the second field.

Hereinafter, an operation of the demultiplexer in the second field will be described in reference to FIG. 6 and FIG. 7. FIG. 6 shows driving timing diagrams of the demultiplexer in the second field, and FIG. 7 shows pixels turned on in the second field. The pixels that are turned on in the second field are the ones that are not shown as grayed or blacked out in FIG. 7.

In the second field, the switches S1 and S2 are turned off and on so as to alternately apply the data signals to two adjacent data lines Data[2*i*] and Data[2*i*−1] while the selection signal is applied to the scan lines select1[1] to select1[*m*], as shown in FIG. 6.

It can be seen from FIGS. 5 and 7 that the pixel circuits turned on in the first field are not turned on in the second field, and the pixel circuits not turned on in the first field are turned on in the second field. This is achieved in the second field by turning on the switch S1 and turning off the switch S2 when the select signal is applied to the even scan lines select1[2*i*] and turning off the switch S1 and turning on the switch S2 when the select signal is applied to the odd scan lines select1[2*i*−1].

As described, the second exemplary embodiment of the present invention employs a duty driving method which allows light emission during a half period (i.e., one of two fields) of a single frame, and thus the size of data current can be doubled compared to that of a conventional driving method. Therefore, shortage of data programming time due to the use of a demultiplexer can also be solved by doubling the size of the data current.

However, as a result of using the demultiplexer according to the second exemplary embodiment of the present invention, some pixel circuits may be able to emit light although the data signal is not programmed thereto due to parasitic components (e.g., parasitic capacitances) present in the data lines. This problem occurs because capacitors in the pixel circuits are not fully discharged when parasitic components present in the data lines are large.

Figure 8:
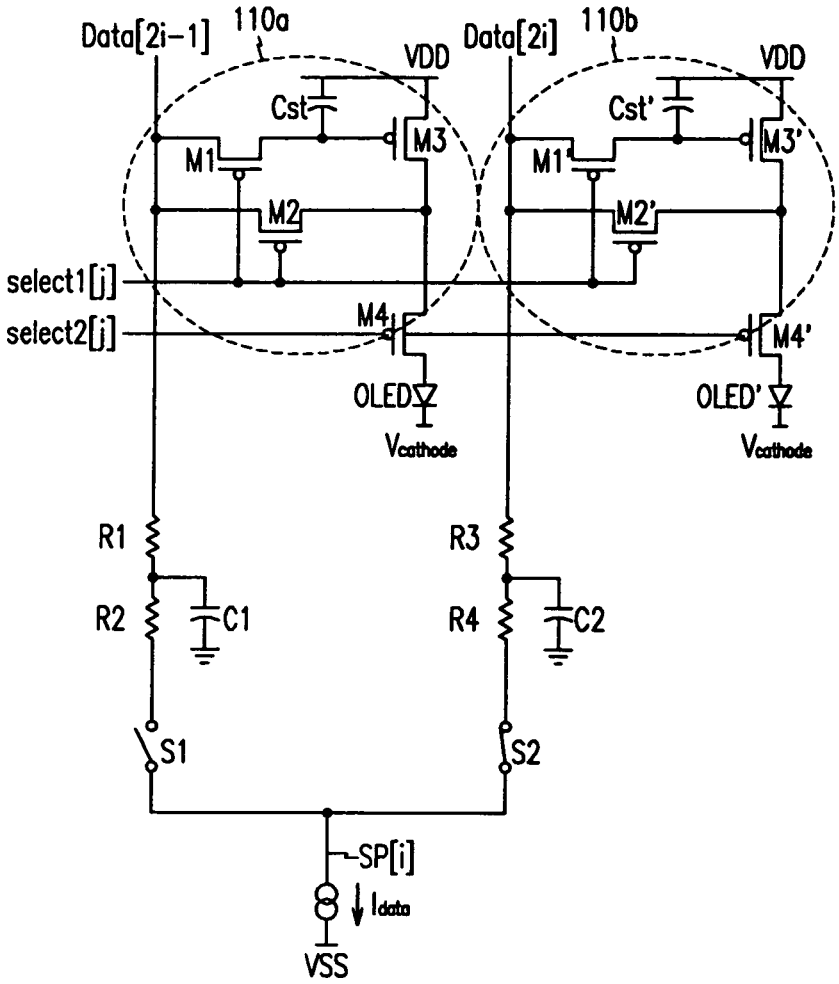
FIG. 8 exemplarily illustrates parasitic components present in data lines coupled to the demultiplexer according to the second exemplary embodiment of the present invention.

In FIG. 8, the parasitic components present in the data lines, for example, are represented by equivalent parasitic resistors R1 to R4 and equivalent parasitic capacitances C1 and C2.

As shown therein, when the parasitic capacitances C1 and C2 are present in the data lines Data[2*i*−1] and Data[2*i*], the capacitors Cst and Cst' and the parasitic capacitors C1 and C2 are coupled to each other by the transistors M1 and M2 of the pixel circuit 110*a* and the transistors M1' and M2' of the pixel circuit 110*b* when the selection signal is applied to the selection scan line select1[*j*].

Therefore, a voltage corresponding to the data current is stored in the capacitors Cst and Cst' of the pixel circuits 110*a* and 110*b*, and the size of voltage in the parasitic capacitors C1 and C2 present in the data lines Data[2*i*] and Data[2*i*−1] are changed depending on the data current when the data current is demultiplexed and programmed to the data lines Data[2*i*] and Data[2*i*−1].

Here, changing the size of the voltage at the parasitic capacitances C1 and C2 takes longer as the data current becomes smaller, and accordingly much time is consumed for storing the voltage corresponding to the data current in the capacitors Cst and Cst' of the pixel circuits 110*a* and 110*b* or discharging the capacitors Cst and Cst'.

Consequently, the capacitors Cst and Cst', respectively, are not fully discharged when no current or the current of 0A is applied by the data driver 400 to the pixel circuits 110*a* and 110*b*, respectively, or when the switches S1 and S2 are turned off, respectively, while the selection signal is applied to the selection scan line select1[*j*]. Moreover, when the emission signal is applied to the emission scan line select2[*j*], the OLED display element OLED or OLED' emits light due to the voltage at the capacitor Cst or Cst'. Such emission of light by a pixel circuit 110*a* or 110*b* caused by the parasitic capacitance when it is not programmed during the current field is undesirable.

In particular, a particular pixel circuit (i.e., the pixel circuit 110*a*) set to display a black colored image cannot display the image because the particular pixel circuit emits light, thereby decreasing contrast of the display panel.

Thus the demultiplexer according to a third exemplary embodiment of the present invention couples additional switches between the driving transistors M3 and M3' of the pixel circuits 110*a* and 110*b* and the OLED elements (OLED and OLED') to control on and off switching to thereby prevent the pixel circuits 110*a* and 110 from emitting light due to the parasitic capacitances when no data current or 0A of data current is applied to the pixel circuits 110*a* and 110*b*, or when the switches S1 and S2 are turned off.

Figure 9:
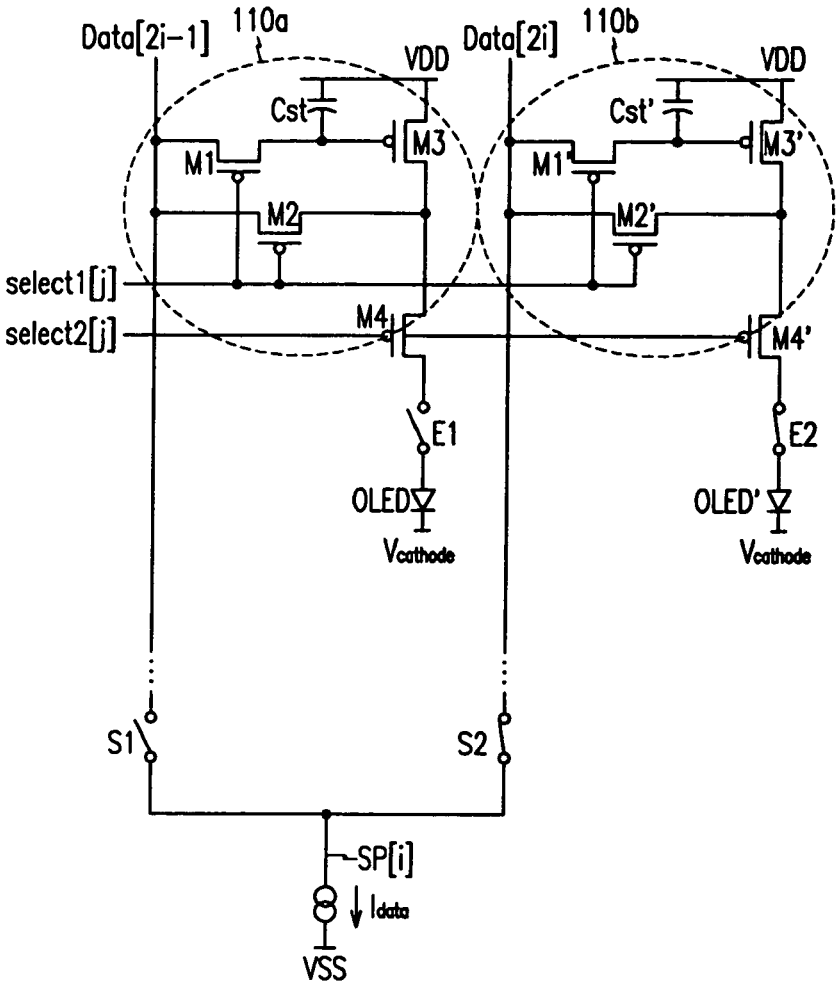
FIG. 9 illustrates a relationship between the demultiplexer and a pixel circuit according to a third exemplary embodiment of the present invention.

FIG. 9 illustrates a relationship between the demultiplexer and the pixel circuits according to the third exemplary embodiment of the present invention.

As shown therein, the demultiplexer according to the third exemplary embodiment of the present invention further includes switches E1 and E2 coupled between the driving transistors M3 and M3' and the OLED elements (OLED and OLED'), differing from the pixel circuit shown in FIG. 3.

When the demultiplexer further includes the switches E1 and E2, the switch E1 is turned on in the first field to transmit a current of the transistor M3 to the OLED element (OLED), and the switch E2 is turned off to block a current of the transistor M3' flowing to the OLED element (OLED'). Similarly, the switch E2 is turned on in the second field, and the switch E1 is turned off to block the current flowing to the OLED element (OLED) of the pixel circuit 110*a*.

Accordingly, a current corresponding to data stored in the capacitor Cst flows to the OLED element (OLED) in the first field, and a current corresponding to data stored in the capacitor Cst' flows to the OLED element (OLED') in the second field.

Thus, the influence of the parasitic capacitance present in the data lines Data[2*i*−1], Data[2*i*] on the pixel circuit is reduced or prevented, which parasitic capacitance would otherwise increase average luminance of the black image and deteriorate contrast of the display panel.

Figure 10:
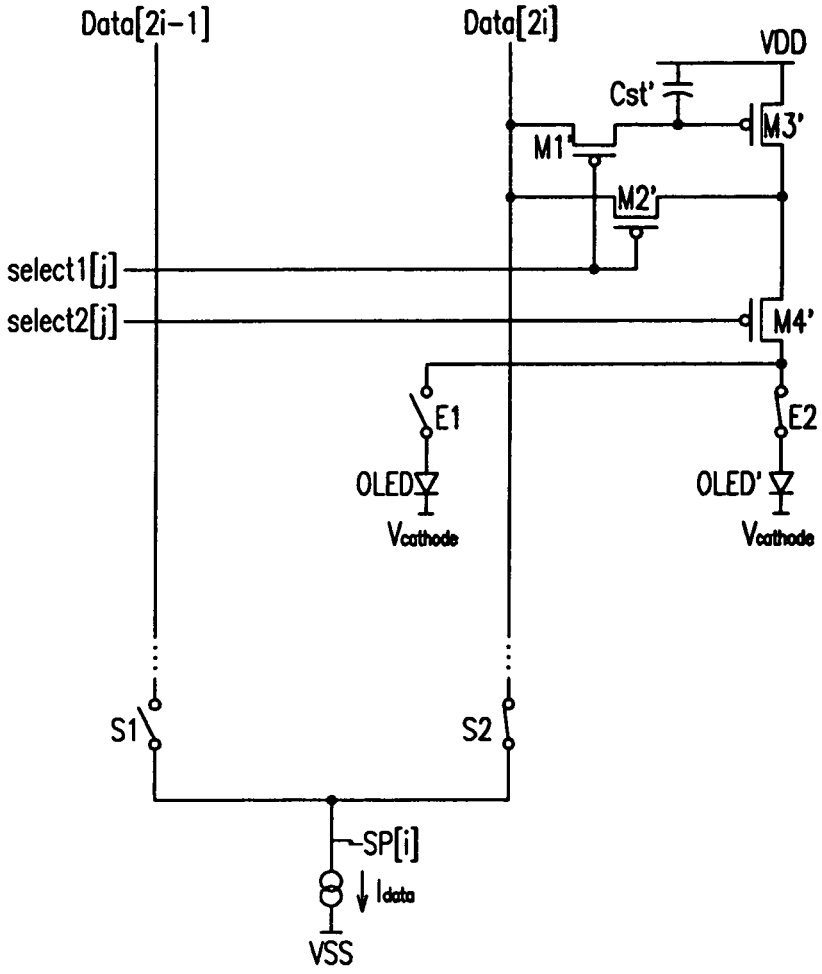
FIG. 10 illustrates a relationship between the demultiplexer and a pixel circuit according to a fourth exemplary embodiment of the present invention.

FIG. 10 shows a relationship between a demultiplexer and a pixel circuit according to a fourth exemplary embodiment of the present invention.

In the fourth exemplary embodiment of the present invention, which differs from the embodiment described in with reference to FIG. 9, the transistors M1 M2, M3 and M4 and the capacitor Cst of the pixel circuit 110*a* are removed, and the switches E1 and E2 are respectively coupled between the transistor M4' and the OLED elements (OLED and OLED'), differing from the embodiment descried in FIG. 9.

In detail, the transistors M3 and M3' asynchronously transmit the current and the switches E1 and E2 are not concurrently turned on according to the third exemplary embodiment of the present invention. Thus, the transistors M1, M2, M3 and M4 of the pixel circuit 110*a* are removed, and an electrode of the switch E1 coupled to the transistor M4 and an electrode of the switch E2 coupled to the transistor M4' can be incorporated according to the fourth exemplary embodiment of the present invention.

Here, the transistors M1', M2', M3' and M4' of the pixel circuit 110*b* perform as the transistors M1, M2, M3 and M4 in the first field, and the switch E2 having the electrodes coupled to the transistor M4' demultiplexes the current flowing from the transistor M3' and transmits the current to the OLED elements (OLED and OLED').

In a like manner, the pixel circuit 110*b* supplies the current flowing to the OLED elements (OLED and OLED').

Figure 11:
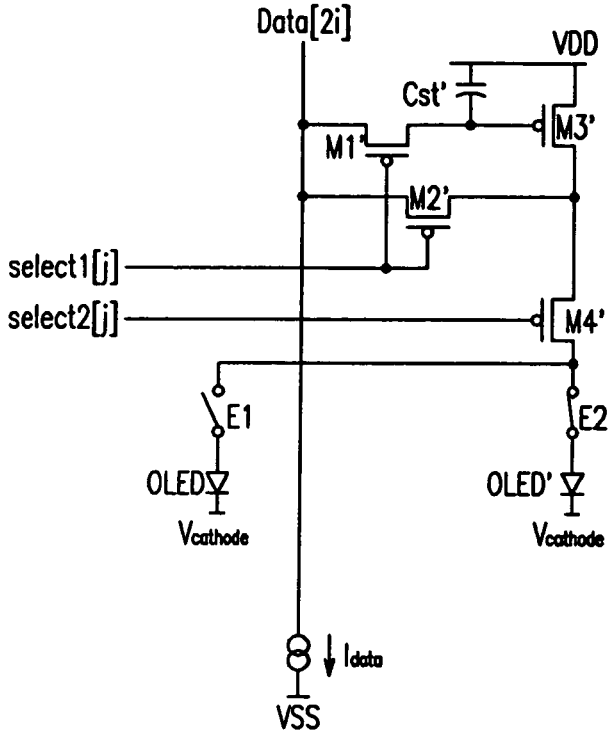
FIG. 11 illustrates a relationship between the demultiplexer and a pixel circuit according to a fifth exemplary embodiment of the present invention.

FIG. 11 illustrates a relationship between a demultiplexer and a pixel circuit according to a fifth exemplary embodiment of the present invention.

According to the fifth exemplary embodiment of the present invention, the switches S1 and S2 in FIG. 10 are removed, thereby differing from the fourth exemplary embodiment of the present invention.

In particular, when the switches E1 and E2 demultiplex a current flowing from the transistor M3' and transmit the current to the OLED elements (OLED and OLED'), the switch S1 is turned off and the switch S2 is turned on in the first and second fields. Accordingly, the data line Data[2*i*−1] is not necessary in the first and second field, and therefore the switches S1 and S2 and the data line Data[2*i*−1] can be removed in the fifth exemplary embodiment of the present invention.

Figure 13:
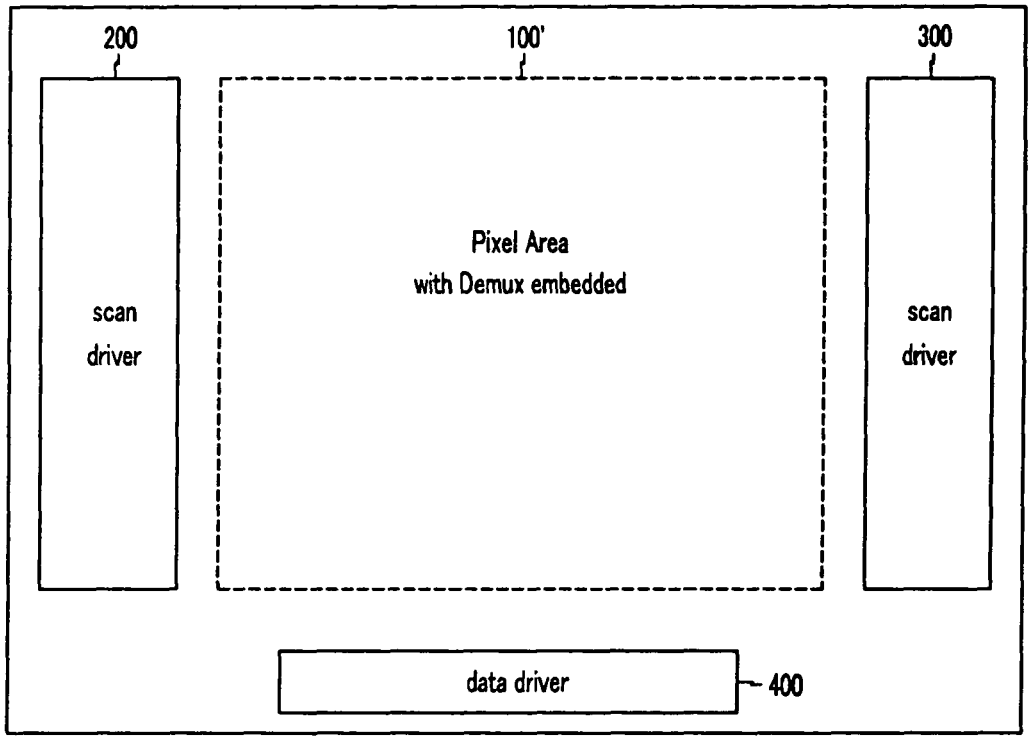
FIG. 13 illustrates a display device according to the second exemplary embodiment of the present invention.

Thus, the demultiplexer is embedded to the pixel circuit according to the fifth exemplary embodiment of the present invention, and a display device has a pixel area 100 to which the demultiplexer is embedded as shown in FIG. 13.

Figure 12:
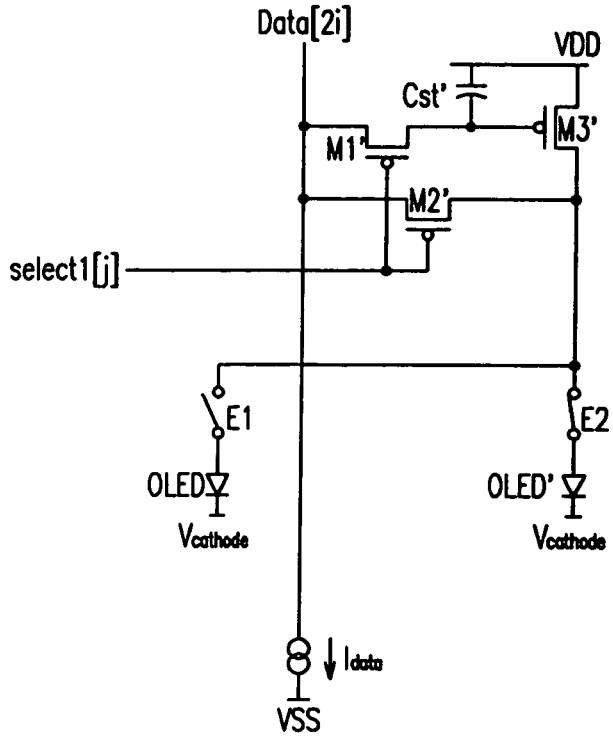
FIG. 12 illustrates a relationship between the demultiplexer and a pixel circuit according to a sixth exemplary embodiment of the present invention.

FIG. 12 shows a relationship between a pixel circuit and a demultiplexer according to a sixth exemplary embodiment of the present invention.

The pixel circuit according to the sixth exemplary embodiment of the present invention does not include the transistor M4' in FIG. 11, thereby differing from the pixel circuit according to the fourth exemplary embodiment of the present invention.

In detail, by turning off the switches E1 and E2 rather than turning off the transistor M4' in FIG. 11, the transistor M4 can be replaced with the switches E1 and E2.

Accordingly, a total number of IC in the data driver 400 used to demultiplex the current corresponding to the two data signals using the switches E1 and E2 can be reduced.

Here, data signals corresponding to an image to be displayed by the OLED elements (OLED and OLED') are sequentially applied to the data line Data[2*i*]. Further, in the case that the demultiplexer is employed in a display device displaying red, green, and blue colors, a data signal corresponding to two colors can be applied to a single data line. In other words, data signals having different voltage ranges can be applied to the data line.

FIG. 13 illustrates the display device having the demultiplexer embedded to a pixel area 100', which may otherwise be the same as the pixel area 100 according to the second exemplary embodiment of the present invention.

As described, in the case of using the pixel circuit in FIG. 11 or FIG. 12, the demultiplexer is embedded to the pixel area, and thus the transistors M1 M2, M3, and M4 and the data line Data[2*i*−1] are removed, thereby increasing an aperture ratio of the display panel.

In addition, the demultiplexer is formed in the pixel circuit, and thus a plurality of OLED elements can be driven using a single pixel circuit. Accordingly, pitches between pixels are decreased, thereby increasing the maximum number of pixels per unit length.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

For instance, the pixel circuit according to the third exemplary embodiment of the present invention is a pixel circuit according to an embodiment of the present invention, and not limited thereto. The pixel circuit can be implemented by other circuit as long as the circuit is capable of inputting data signals and outputting a current corresponding to the data signals.

In addition, the switch in FIG. 2 to FIG. 12 can be provided as an N-channel or a P-channel transistor. The transistor should be but a thin film transistor not necessarily having gate, drain, and source electrodes as first, second, and third electrodes, respectively.

Further, a demultiplexer including plurality of switches can be coupled to a single driving transistor to demultiplex a current and transmit the current to a plurality of OLED elements. Herein, the demultiplexer according to the present invention is not restricted to the 1:2 demultiplexer.

What is claimed is:

1. A display apparatus comprising:

a data driver for outputting data currents as image signals;

a plurality of data lines for transmitting the data currents;

a plurality of scan lines configured to transmit selection signals;

a demultiplexer configured to time-divisionally demultiplex the data currents, to transmit demultiplexed data currents alternately to two adjacent ones of a plurality of demultiplexed data lines;

a plurality of pixel circuits coupled to the demultiplexed data lines, and the scan lines, each of the pixel circuits comprising a driving circuit configured to provide a driving current corresponding to a respective one of the demultiplexed data currents; and a common current source connected to at least one of the data lines and configured to provide the data currents for programming at least one of the pixel circuits to drive two adjacent ones of light emitting elements in a same row corresponding to a same one of the scan lines, wherein the demultiplexed data currents on the two adjacent ones of the demultiplexed data lines are provided, in a first field, to one of the pixel circuits coupled to both a first one of the two adjacent ones of the demultiplexed data lines and one of the plurality of scan lines and one of the pixel circuits coupled to both a second one of the two adjacent ones of the demultiplexed data lines and a next one of the plurality of scan lines, and in a second field, to one of the pixel circuits coupled to both the second one of the two adjacent ones of the demultiplexed data lines and the one of the plurality of scan lines and one of the pixel circuits coupled to both the first one of the two adjacent ones of the demultiplexed data lines and the next one of the plurality of scan lines, such that for a duration of one of the selection signals on the one of the plurality of scan lines, only one of the two adjacent ones of the plurality of demultiplexed data lines receives a respective one of the demultiplexed data currents.

2. The display apparatus according to claim 1, wherein the data driver is configured to time-divide the data currents, and to output time-divided data currents.

3. The display apparatus according to claim 1, wherein the demultiplexer comprises at least two switches, wherein the driving circuit is coupled between one of the at least two switches and a light emitting element in the display apparatus.

4. The display apparatus according to claim 1, wherein the driving circuit comprises:

a driving transistor coupled between a first power source and the demultiplexer, and for providing the driving current to a light emitting element in accordance with a gate-source voltage of the driving transistor; and a capacitor coupled between a gate and a source of the driving transistor, and for storing and maintaining a voltage corresponding to the respective one of the demultiplexed data currents for a predetermined period of time.

5. The display apparatus according to claim 4, wherein one of at least two switches of the demultiplexer is configured to be turned on when the voltage corresponding to the respective one of the demultiplexed data currents is charged to the capacitor.

6. The display apparatus according to claim 4, wherein one of the plurality of scan lines is further configured to transmit a respective one of the selection signals to select a pixel circuit of the pixel circuits to which the voltage corresponding to the respective one of the demultiplexed data currents is stored.

7. The display apparatus according to claim 6, wherein the driving circuit further comprises:

a first switch for transmitting the respective one of the demultiplexed data currents to the driving transistor in response to the respective one of the selection signals; and a second switch for diode-connecting the driving transistor in response to the respective one of the selection signals.

8. The display apparatus according to claim 1, wherein the demultiplexed data currents provided through the demultiplexer correspond to a plurality of gray levels expressed by light emitting elements of the display apparatus.

9. A display apparatus comprising:

a display area comprising a plurality of demultiplexed data lines for transmitting demultiplexed data currents, a plurality of scan lines for transmitting selection signals, and a plurality of pixel circuits coupled to the demultiplexed data lines and the plurality of scan lines, a data driver for generating data currents to be programmed to the plurality of pixel circuits, and for applying a respective one of the data currents to each of a plurality of data lines;

a plurality of light emitting elements configured to display an image corresponding to a respective one of the demultiplexed data currents;

a scan driver for generating the selection signals and for applying the selection signals to the plurality of scan lines;

a demultiplexer configured to time-divisionally demultiplex the data currents, and to transmit the demultiplexed data currents alternately to two adjacent ones of the plurality of demultiplexed data lines; and a common current source connected to at least one of the data lines and configured to provide the data currents for programming at least one of the pixel circuits to drive two adjacent ones of light emitting elements in a same row corresponding to a same one of the scan lines, wherein the demultiplexed data currents on the two adjacent ones of the demultiplexed data lines are provided, in a first field, to one of the pixel circuits coupled to both a first one of the two adjacent ones of the demultiplexed data lines and one of the plurality of scan lines and one of the pixel circuits coupled to both a second one of the two adjacent ones of the demultiplexed data lines and a next one of the plurality of scan lines, and in a second field, to one of the pixel circuits coupled to both the second one of the two adjacent ones of the demultiplexed data lines and the one of the plurality of scan lines and one of the pixel circuits coupled to both the first one of the two adjacent ones of the demultiplexed data lines and the next one of the plurality of scan lines, such that for a duration of one of the selection signals on the one of the plurality of scan lines, only one of the two adjacent ones of the plurality of demultiplexed data lines receives a respective one of the demultiplexed data currents.

10. The display apparatus according to claim 9, wherein each of the plurality of pixel circuits comprises:

a driving transistor having a first electrode, a second electrode coupled to a first power source, and a third electrode, and configured to provide a driving current from the third electrode corresponding to a voltage between the first and the second electrodes; and a capacitor coupled between the first and second electrodes of the driving transistor, and configured to store a voltage corresponding to a respective one of the demultiplexed data currents for a predetermined period of time.

11. The display apparatus according to claim 10, wherein the demultiplexer comprises at least two switches, wherein each of the pixel circuits is coupled between a respective one of the at least two switches and a respective one of the light emitting elements.

12. The display apparatus according to claim 11, wherein one of the at least two switches of the demultiplexer is configured to be turned on when the voltage corresponding to the respective one of the demultiplexed data currents is stored in the capacitor.

13. The display apparatus according to claim 9, wherein the demultiplexed data currents respectively correspond to a plurality of gray levels expressed by the light emitting elements.

14. The display apparatus according to claim 9, wherein the display area, the data driver, and the scan driver are substantially formed on a same glass substrate.

15. The display apparatus according to claim 9, wherein each of data currents corresponds to at least two of the light emitting elements.

16. A display panel comprising:

a data driver for providing data currents as image signals;

a plurality of data lines for transmitting the data currents;

a plurality of scan lines configured to transmit selection signals;

a demultiplexer configured to time-divisionally demultiplex the data currents, to transmit demultiplexed data currents alternately to two adjacent ones of a plurality of demultiplexed data lines;

a plurality of pixel circuits coupled to the demultiplexed data lines, and the plurality of scan lines, each of the pixel circuits comprising a driving circuit configured to provide a driving current corresponding to a respective one of the demultiplexed data currents; and a common current source connected to at least one of the data lines and configured to provide the data currents for programming at least one of the pixel circuits to drive two adjacent ones of light emitting elements in a same row corresponding to a same one of the scan lines, wherein the demultiplexed data currents on the two adjacent ones of the demultiplexed data lines are provided, in a first field, to one of the pixel circuits coupled to both a first one of the two adjacent ones of the demultiplexed data lines and one of the plurality of scan lines and one of the pixel circuits coupled to both a second one of the two adjacent ones of the demultiplexed data lines and a next one of the plurality of scan lines, and in a second field, to one of the pixel circuits coupled to both the second one of the two adjacent ones of the demultiplexed data lines and the one of the plurality of scan lines and one of the pixel circuits coupled to both the first one of the two adjacent ones of the demultiplexed data lines and the next one of the plurality of scan lines, such that for a duration of one of the selection signals on the one of the plurality of scan lines, only one of the two adjacent ones of the plurality of demultiplexed data lines receives a respective one of the demultiplexed data currents.

17. The display panel according to claim 16, wherein the data driver is configured to time-divide the data currents and to output the time-divided data currents.

18. The display panel according to claim 16, wherein the demultiplexed data currents respectively correspond to a plurality of gray levels expressed by light emitting elements of the display panel.

19. A driving method of a display apparatus comprising a plurality of data lines for transmitting data currents, a plurality of scan lines for transmitting selection signals, a demultiplexer for demultiplexing the data currents to transmit demultiplexed data currents alternately to two adjacent ones of a plurality of demultiplexed data lines, and a plurality of pixel circuits coupled to the demultiplexed data lines and the plurality of scan lines, the method comprising:

applying one of the selection signals to a respective one of the pixel circuits;

storing a voltage corresponding to a respective one of the demultiplexed data currents to the respective one of the pixel circuits while the one of the selection signals is applied; and providing a driving current corresponding to the respective one of the demultiplexed data currents, providing the data currents for programming at least one of the pixel circuits to drive two adjacent ones of light emitting elements in a same row corresponding to a same one of the scan lines using a common current source connected to at least one of the data lines, wherein the demultiplexed data currents on the two adjacent ones of the demultiplexed data lines are provided, in a first field, to one of the pixel circuits coupled to both a first one of the two adjacent ones of the demultiplexed data lines and one of the plurality of scan lines and one of the pixel circuits coupled to both a second one of the two adjacent ones of the demultiplexed data lines and a next one of the plurality of scan lines, and in a second field, to one of the pixel circuits coupled to both the second one of the two adjacent ones of the demultiplexed data lines and the one of the plurality of scan lines and one of the pixel circuits coupled to both the first one of the two adjacent ones of the demultiplexed data lines and the next one of the plurality of scan lines, such that for a duration of one of the selection signals on the one of the plurality of scan lines, only one of the two adjacent ones of the plurality of demultiplexed data lines receives a respective one of the demultiplexed data currents.

20. The driving method according to claim 19, wherein the demultiplexed data currents respectively correspond to a plurality of gray levels expressed by light emitting elements of the display apparatus.

21. A display apparatus comprising:

a data driver for outputting data currents as an image signal;

a plurality of data lines for transmitting the data currents;

a plurality of scan lines configured to transmit selection signals;

a plurality of emission lines configured to transmit emission signals;

a demultiplexer configured to time-divisionally demultiplex the data currents, to transmit demultiplexed data currents alternately to two adjacent ones of a plurality of demultiplexed data lines;

a plurality of pixel circuits coupled to the demultiplexed data lines, the plurality of emission lines, and the plurality of scan lines, each of the pixel circuits comprising a driving circuit configured to provide a driving current corresponding to a respective one of the demultiplexed data currents in response to a respective one of the emission signals;

a light emitting element for outputting light corresponding to the driving current from the driving circuit; and a common current source connected to at least one of the data lines and configured to provide the data currents for programming at least one of the pixel circuits to drive two adjacent ones of light emitting elements in a same row corresponding to a same one of the scan lines, wherein the demultiplexed data currents on the two adjacent ones of the demultiplexed data lines are provided, in a first field, to one of the pixel circuits coupled to both a first one of the two adjacent ones of the demultiplexed data lines and one of the plurality of scan lines and one of the pixel circuits coupled to both a second one of the two adjacent ones of the demultiplexed data lines and a next one of the plurality of scan lines, and in a second field, to one of the pixel circuits coupled to both the second one of the two adjacent ones of the demultiplexed data lines and the one of the plurality of scan lines and one of the pixel circuits coupled to both the first one of the two adjacent ones of the demultiplexed data lines and the next one of the plurality of scan lines, such that for a duration of one of the selection signals on the one of the plurality of scan lines, only one of the two adjacent ones of the plurality of demultiplexed data lines receives a respective one of the demultiplexed data currents.

22. The display apparatus according to claim 21, wherein the driving circuit comprises:

a driving transistor coupled between a first power source and the light emitting element for controlling the driving current flowing to the light emitting element that corresponds to the respective one of the demultiplexed data currents; and a capacitor coupled between a gate and a source of the driving transistor, and for storing and maintaining a voltage corresponding to the respective one of the demultiplexed data currents.

23. The display apparatus according to claim 21, wherein a first pixel circuit of the plurality of pixel circuits is configured to be turned on and a second pixel circuit of the plurality of pixel circuits is configured to be turned off during a first period, and the second pixel circuit is configured to be turned on and the first pixel circuit is configured to be turned off during a second period.

* * * * *

UNITED STATES PATENT AND TRADEMARK OFFICE

CERTIFICATE OF CORRECTION

PATENT NO. : 8,427,403 B2
APPLICATION NO. : 11/139422
DATED : April 23, 2013
INVENTOR(S) : Dong-Yong Shin et al.

It is certified that error appears in the above-identified patent and that said Letters Patent is hereby corrected as shown below:

On the Title Page

| | |
|---|---|
| Item (57) Abstract, line 4 | Delete "lines"<br>Insert -- lines. -- |
| Item (57) Abstract, line 9 | After "at"<br>Insert -- least two -- |

In the Claims

| | |
|---|---|
| Column 12, Claim 15, line 25 | After "each of"<br>Insert -- the demultiplexed -- |

Signed and Sealed this
Sixth Day of January, 2015

Michelle K. Lee

Michelle K. Lee
*Deputy Director of the United States Patent and Trademark Office*